US007572097B2

(12) United States Patent
Jaeger

(10) Patent No.: US 7,572,097 B2
(45) Date of Patent: Aug. 11, 2009

(54) IMPELLER PUMP HOUSING AND IMPELLER

(75) Inventor: Laurel B. Jaeger, Dowagiac, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 347 days.

(21) Appl. No.: 11/431,386

(22) Filed: May 10, 2006

(65) Prior Publication Data

US 2007/0264127 A1 Nov. 15, 2007

(51) Int. Cl.
*F04D 13/12* (2006.01)
*F04D 29/42* (2006.01)

(52) U.S. Cl. ..... 415/106; 415/224; 416/175; 416/203

(58) Field of Classification Search ..... 415/104, 415/106, 203, 224; 416/175, 181, 183, 193 R, 416/203

See application file for complete search history.

(56) References Cited

U.S. PATENT DOCUMENTS

| | | | | | |
|---|---|---|---|---|---|
| 1,340,091 | A * | 5/1920 | Trane | 415/55.6 |
| 2,819,675 | A * | 1/1958 | Gilman | 415/58.5 |
| 2,869,651 | A * | 1/1959 | Rose | 416/214 R |
| 3,374,744 | A * | 3/1968 | Toma | 415/203 |
| 3,536,412 | A * | 10/1970 | Conrath et al. | 415/124.2 |
| 4,306,833 | A * | 12/1981 | Sixsmith et al. | 415/55.4 |
| 4,355,954 | A | 10/1982 | Wilson | 415/213 |
| 4,467,627 | A | 8/1984 | Platt et al. | 68/17 |
| 4,904,166 | A | 2/1990 | Wasemann | 417/360 |
| 5,009,570 | A | 4/1991 | Richardson | 415/174.2 |
| 5,257,901 | A | 11/1993 | Malchow | 415/182.1 |
| 5,951,241 | A * | 9/1999 | Dahlheimer | 415/55.4 |
| 6,264,441 | B1 | 7/2001 | Marioni | 427/423.1 |
| 6,685,428 | B1 | 2/2004 | Freudenberg | 415/174.3 |
| 6,857,205 | B1 | 2/2005 | Fusco et al. | 36/114 |
| 6,896,481 | B2 * | 5/2005 | Dahlheimer | 415/126 |

* cited by examiner

*Primary Examiner*—Edward Look
*Assistant Examiner*—Nathaniel Wiehe
(74) *Attorney, Agent, or Firm*—Clifton Green; Michael D. Lafrenz

(57) ABSTRACT

An impeller pump including a body and a cover assembled onto the body to form a housing. The body has a fluid inlet and a fluid outlet and an opening for receiving a rotating drive shaft. An impeller is rotatably positioned in the housing with paddles at a periphery thereof. The impeller includes a sleeve with a central pocket formed therein for receiving a drive shaft, a circumferential support ring, and a plurality of radially extending paddles extending from the circumferential support ring. The body and cover define an annular space circumferentially extending around an interior of the housing for receiving the paddles of the impeller. The cover has a wall portion enlarging the annular space in the housing through a portion of the circumference of the annular space.

15 Claims, 6 Drawing Sheets

IMPELLER PUMP HOUSING AND IMPELLER

BACKGROUND OF THE INVENTION

The present invention relates to impeller pumps and more particularly to the housings and impellers for such pumps.

Impeller pumps are well known and are used for pumping various liquids, such as water and wash liquor in washing machines, for recirculation and to drain. Generally the impeller includes a plurality of vanes carried on a face of an impeller plate, and the entire plate and vanes are rotated by means of a motor via a rotating drive shaft.

In the environment of a clothes washing machine, the liquid flowing through the pump may oftentimes include various solids, such as lint and articles carried in the clothing, for example, coins and jewelry. The confined apace within the pump body, and between the pump body and the impeller, results in the accumulation of these solids, particularly lint, which catches on sharp edges within the pump body, and once caught, act as an accumulation point for additional lint and other solids. This accumulation impedes the movement of the impeller, degrading the performance of the pump, and could ultimately prevent the impeller from rotating, thus terminating operation of the pump. Also, the accumulation of some debris could cause damage to seals within the pump, leading to leakage or failure of the seals.

Impeller pumps, particularly for washing machines, in which the impeller blades are carried on the face of a rotating disc are described, for example in the following U.S. Pat. Nos. 4,355,954; 4,467,627; 4,904,166; 5,009,570; 5,257,901; 6,264,441 and 6,685,428.

Another approach for preventing damage to the pump is disclosed in U.S. Pat. No. 6,857,295, wherein a separate water cavity is provided between the wash tub and the pump inlet, for capturing and holding heavy objects, to prevent them from entering the pump in the first place.

It would be an improvement in the art if an arrangement were provided to overcome the problems caused by lint and other debris in impeller pumps.

SUMMARY OF THE INVENTION

The present invention provides a pump impeller formed of a sleeve with a central pocket formed therein for receiving a drive shaft, a support ring surrounding the sleeve, and a plurality of paddles attached to the support ring at radially inward ends thereof, and extending radially outwardly, without further attachment to other portions of the impeller.

In an embodiment, the pump impeller includes a hub surrounding the sleeve.

In an embodiment, the pump impeller includes a face seal carried in the hub.

In an embodiment, the hub comprises a cylindrical hub wall spaced outwardly of the sleeve by a plurality of radial walls.

In an embodiment, the pump impeller includes a plurality of curved impeller blades extending between the hub and the circumferential support ring.

In an embodiment, the impeller includes a top face wall lying substantially perpendicular to an axis of rotation of the impeller and the curved impeller blades extend from a bottom side of the top face wall.

In an embodiment, the impeller includes a plurality of openings through the top face wall.

In an embodiment, the impeller includes a top face wall lying substantially perpendicular to an axis of rotation of the impeller and the top face wall terminates radially at the circumferential support ring.

In an embodiment, the pump impeller includes a thrust bearing carried at a closed end of the sleeve.

The present invention also provides an impeller pump including a housing formed of a body and a cover assembled onto the body, the body having a fluid inlet and a fluid outlet and an opening for receiving a rotating drive shaft, an impeller rotatably positioned in the housing with water moving blades at a periphery thereof, the body and cover defining an annular space circumferentially extending around an interior of the housing for receiving the water moving blades of the impeller, and the cover having a wall portion configured to enlarge the annular space in the housing through a portion of the circumference of the annular space.

In an embodiment, the housing includes a seal assembly between the body and the impeller, a circumferential rib formed in the housing surrounding the seal assembly, and a window formed in the rib along a portion of its circumference.

In an embodiment, a top surface of the rib is broken by the window.

In an embodiment, the window is positioned on a fluid outlet side of the body.

In an embodiment, a cutwater is formed in the annular space within the housing between the inlet and the outlet, and a leading and a trailing edge of the cutwater are rounded.

In an embodiment, the cutwater is formed in both the body and lid.

In an embodiment, a portion of the cutwater formed in the body extends into a recess formed in the lid.

In an embodiment, the cutwater formed in the lid is connected to a rib surrounding a portion of the impeller.

The present invention also provides an impeller pump having a body and a cover assembled onto the body to form a housing, the body having a fluid inlet and a fluid outlet and an opening for receiving a rotating drive shaft, an impeller rotatably positioned in the housing with paddles at a periphery thereof, the impeller having a sleeve with a central pocket formed therein for receiving a drive shaft, a hub surrounding the sleeve, a face seal carried in the hub, a circumferential support ring surrounding the hub, and a plurality of radially extending paddles extending from the circumferential support ring, the body and cover defining an annular space circumferentially extending around an interior of the housing for receiving the paddles of the impeller, the cover having a wall portion configured to enlarge the annular space in the housing through a portion of the circumference of the annular space.

The changes to the impeller, and the changes to the housing body and cover components, enable the pump to better handle lint and foreign objects. Also, this design increases the pump out performance of the pump at different head heights that the pump must overcome. This means that the pump will perform better (fewer clogs and other volume reduction events) and will pump faster, reducing the time required for various pumping activities, such as the pump out of the wash tub at the end of a wash cycle. Other changes described in greater detail below prevent or reduce the possibility of damage to seals within the impeller pump.

DETAILED DESCRIPTION OF THE PREFERRED EMBODIMENTS

Figure 1:
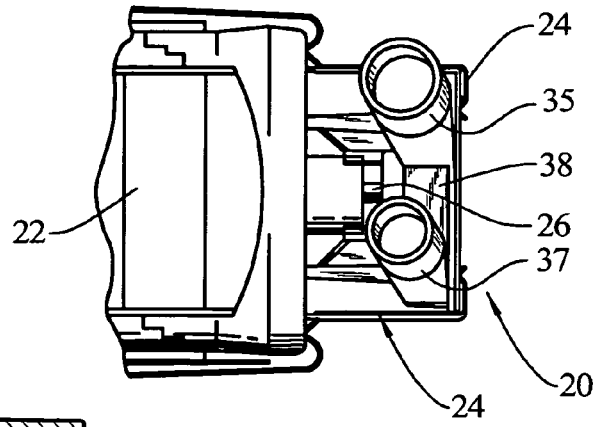
FIG. 1 is a side elevation view of an impeller pump embodying the principles of the present invention mounted on a drive motor.

FIG. 1 illustrates an impeller pump 20 mounted on a drive motor 22, such as the drive motor of a washing machine. However, the present invention is not limited to impeller pumps used on washing machines, even though there is particular utility in such an arrangement. Although a pair of mounting clips 24 are illustrated as holding the pump 20 on the motor 22, the pump could be attached in several other ways, for example other ways are illustrated in U.S. Pat. No. 4,306,841, the disclosure of which is incorporated herein by reference. The motor includes a drive shaft 26 which drives the impeller pump 20.

Figure 2:
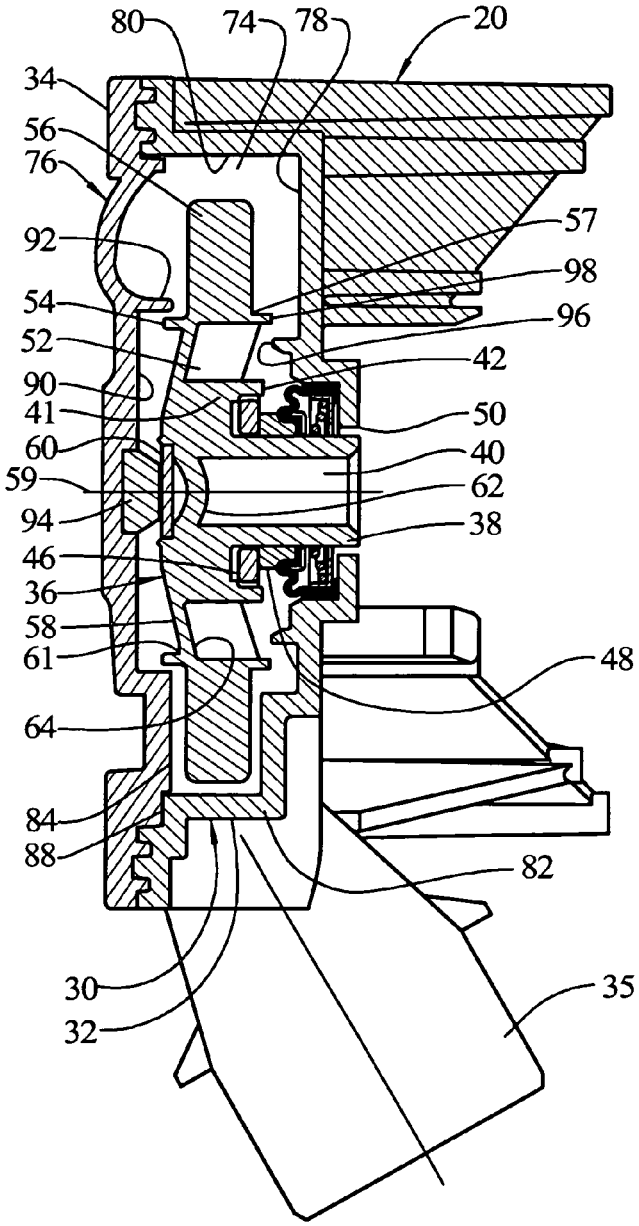
FIG. 2 is a side sectional view of the impeller pump of FIG. 1 shown in isolation.
Figure 8:
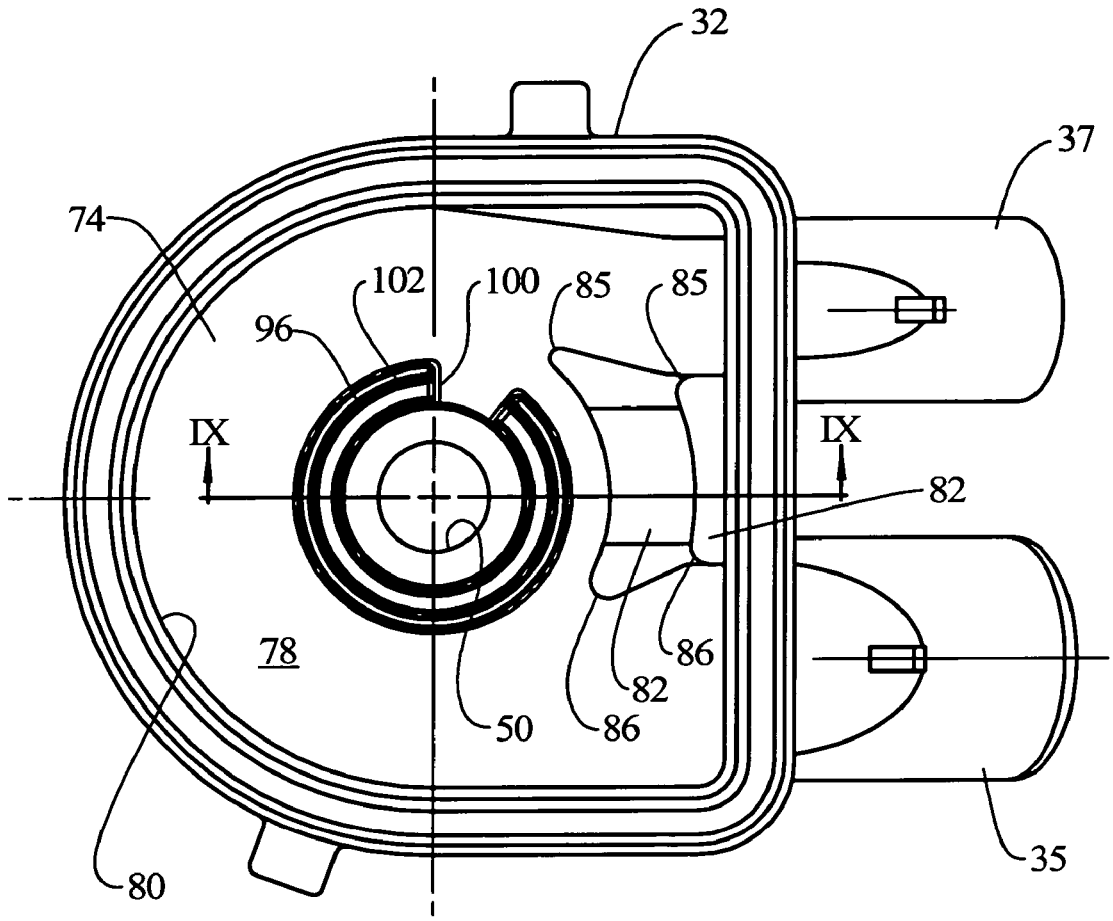
FIG. 8 is an elevational view of an interior side of the housing body of the impeller pump of FIG. 2.
Figure 9:
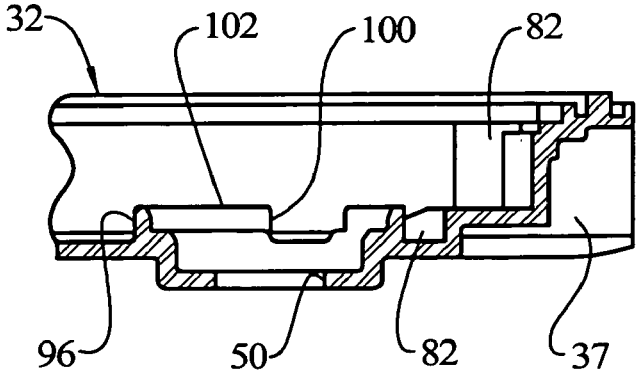
FIG. 9 is a side sectional view of the housing body taken generally along the line IX-IX of FIG. 8.

FIG. 2 shows a cross-sectional view of the impeller pump 20 which includes a housing 30 formed of a body 32 and a cover 34. An impeller 36 is positioned in an interior of the housing 30. As seen in FIGS. 1 and 8, the impeller pump body 32 has a fluid inlet 35 and a fluid outlet 37.

Figure 3:
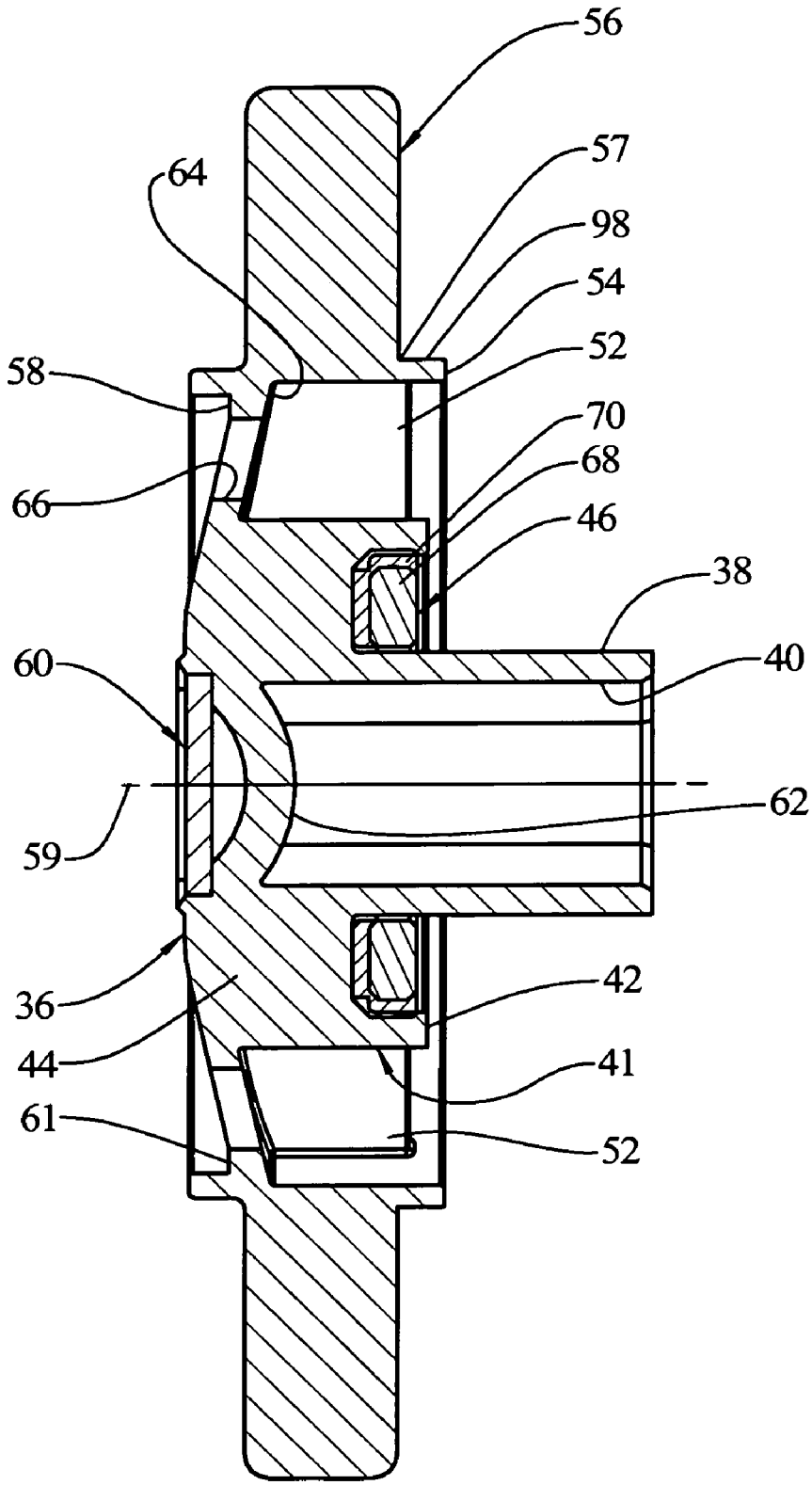
FIG. 3 is a side sectional view of the impeller of the impeller pump of FIG. 2 shown in isolation.
Figure 5:
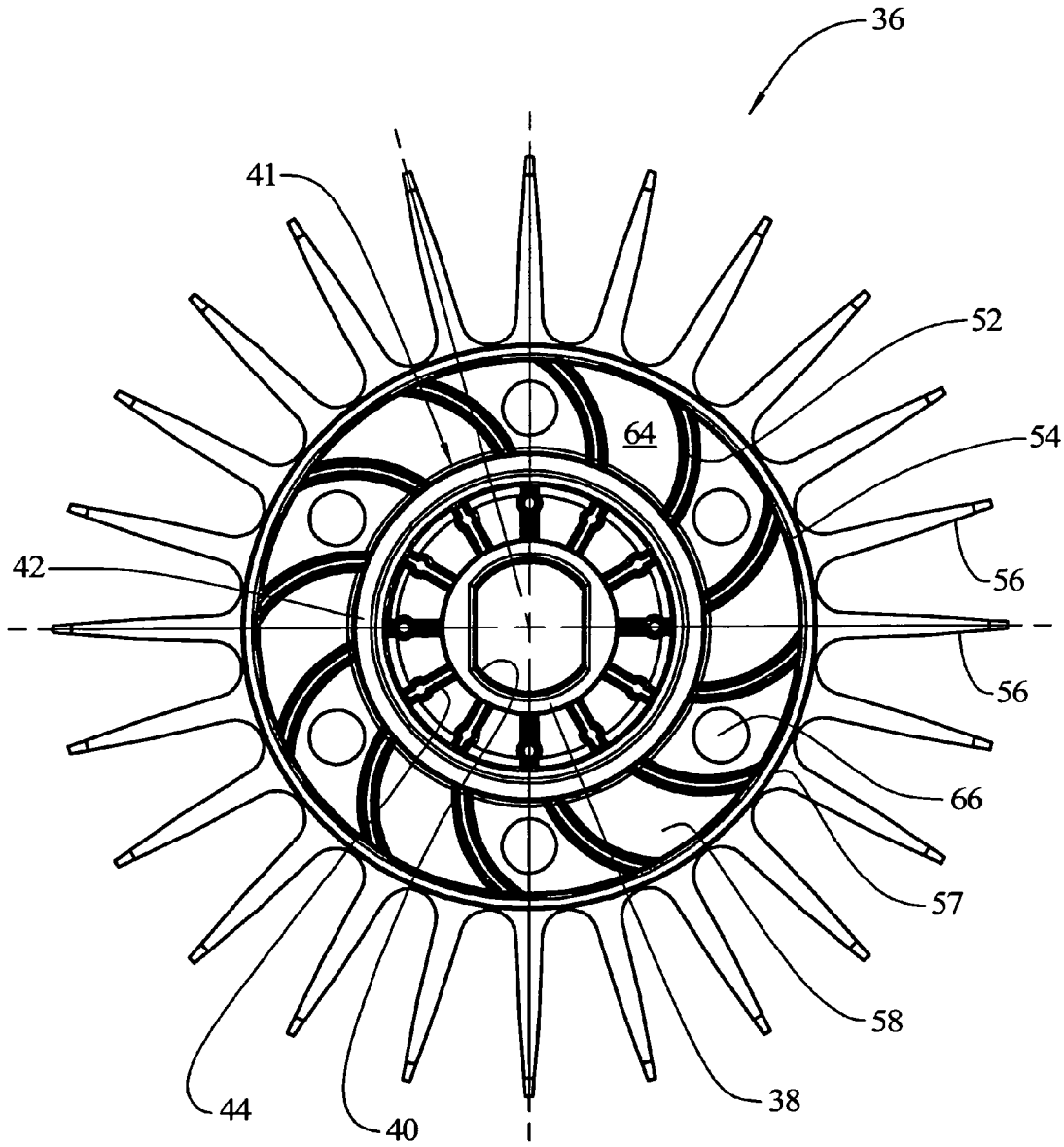
FIG. 5 is a bottom elevational view of the impeller of FIG. 3.

As better seen in FIG. 3, the pump impeller 36 is formed of a sleeve 38 which has a central pocket 40 formed therein for receiving the motor drive shaft 26. The drive shaft 26 may be non-circular in cross section, with the central pocket 40 having the same non-circular cross section, as seen in FIG. 5. A diameter of the central pocket 40 should be sized just slighter larger than the outside diameter of the drive shaft 26 to allow for a relatively snug slip fit to prevent rocking of the impeller 34 on the drive shaft.

The impeller 36 also has a hub 41 surrounding the sleeve 38. The hub 41 may be formed of a circumferential wall 42 spaced outwardly from the sleeve 38 by a plurality of radially oriented walls 44 (FIG. 5). A face seal 46 may be carried in the hub 41. The face seal 46 engages with a stationary seal assembly 48 (FIG. 2) mounted in the housing body 32 to prevent leakage of liquid from within the pump housing 30 through an opening 50 in the housing for the drive shaft 26.

A plurality of curved impeller blades 52 (FIG. 5) extend between the hub 41 and a circumferential support ring 54. The curved impeller blades 52 space and support the circumferential support ring 54 on the hub 41, and also provide a turbulence to the liquid within the pump 20, as described below.

A plurality of radially extending paddles 56 attach to the circumferential support ring 54 at radially inward ends 57 thereof. The paddles 56 extend radially outwardly from the support ring 54, without further attachment to other portions of the impeller 36. With the paddles 56 extending freely from the support ring 54, the space between the paddles is opened up, as compared to face mounted impeller blades of current design pump impellers, providing space for more water and/or larger lint balls and foreign objects to ride around the water path from the inlet 35 to the outlet 37. The increased open space between adjacent paddles 56 also enables the pump 20 to increase its performance. As an example, in a washing machine, there often is a stand pipe for the discharge hose from the pump to connect to. This stand pipe has an opening elevated relative to the position of the pump, so there is a head height that the pump must overcome in order to pump liquid out of the washer. When pumps constructed according to the present invention were tested in comparison with commercially available pumps, with a head height of 34 inches there was a 17.15% increase in performance (length of time required to pump out a defined volume in the wash tub), with a head height of 72 inches, there was a 20.76% increase in performance, and with a head height of 96 inches, there was a 24.22% increase in performance.

Figure 4:
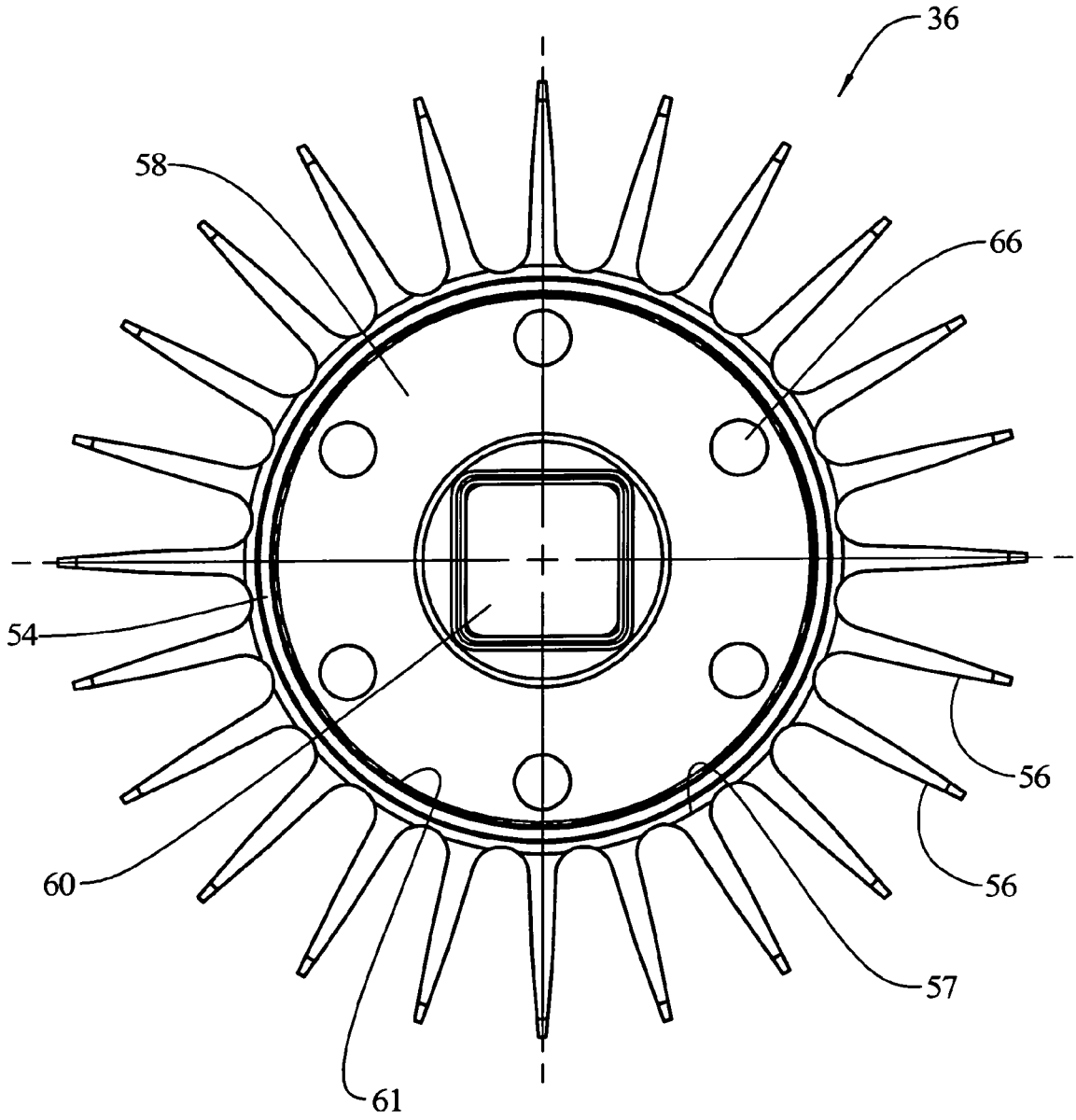
FIG. 4 is a top elevational view of the impeller of FIG. 3.

The impeller 36 may also include a top face wall 58 (FIGS. 3-5) lying substantially perpendicular to an axis of rotation 60 of the impeller, although as shown in FIG. 3, the top face wall may be angled slightly from exactly perpendicular, such as by 15 to 20°, from the center of the impeller to the support ring 54. Thus, an outer edge 61 of the top face wall 58 may be spaced slightly below a top of the support ring 54. The designation "top" is used herein for an orientation reference only, and does not require the pump or impeller to be oriented in an particular direction when in use. The top face wall 58 terminates radially at the circumferential support ring 54, and otherwise forms a top surface for the impeller 36 radially inward of the support ring. As shown in FIG. 3, at a central portion of the top face wall 58, a thrust disc 60 is carried by the top face wall, at a position on the opposite side of the top face wall from a closed end 62 of the sleeve 38.

The curved impeller blades 52 extending between the hub 41 and the support ring 54 extend from a bottom side 64 of the top face wall 58. A plurality of openings 66 may be provided through the top face wall 58 in the region between the hub 41 and the support ring 54 to allow liquid to pass through the top face wall while the pump 20 is in operation. The curved blades 52 on the bottom side of the impeller 36 help to keep the liquid in this area in a turbulent flow pattern. This helps to prevent the build up of lint balls in the area of a rubber boot of the seal assembly 48.

The impeller 36 may be formed in one piece from a nylon material such as DuPont Zytel, in a molding process, and the thrust disc 60 pressed into the impeller after it is formed. Preferably the thrust disc 60 is formed of a stainless steel material for purposes discussed below.

The face seal 46 is also pressed into the impeller 36 after it is formed. The face seal 46 may be may be formed of a ceramic material 68 with rubber 70 molded over the ceramic material. The ceramic material 68 provides the smooth surface for the sliding seal interface, while the rubber overmolding 70 resiliently holds the face seal 46 in the impeller 36, supported on the radial walls 44, which minimizes tracking (debris penetration and/or leakage) of the face seal.

The body 32 and the assembled cover 34 define an annular space 74 circumferentially extending around an interior of the housing 30 for receiving the liquid moving paddles 56 of the impeller. A cross section of the annular space 74 varies in size throughout its circumference, with one portion being just slightly larger than an area filled by the impeller paddles 56, as shown in the bottom portion of FIG. 2, and another portion being substantially larger than an area filled by the impeller paddles, as shown in the top portion of FIG. 2.

Figure 6:
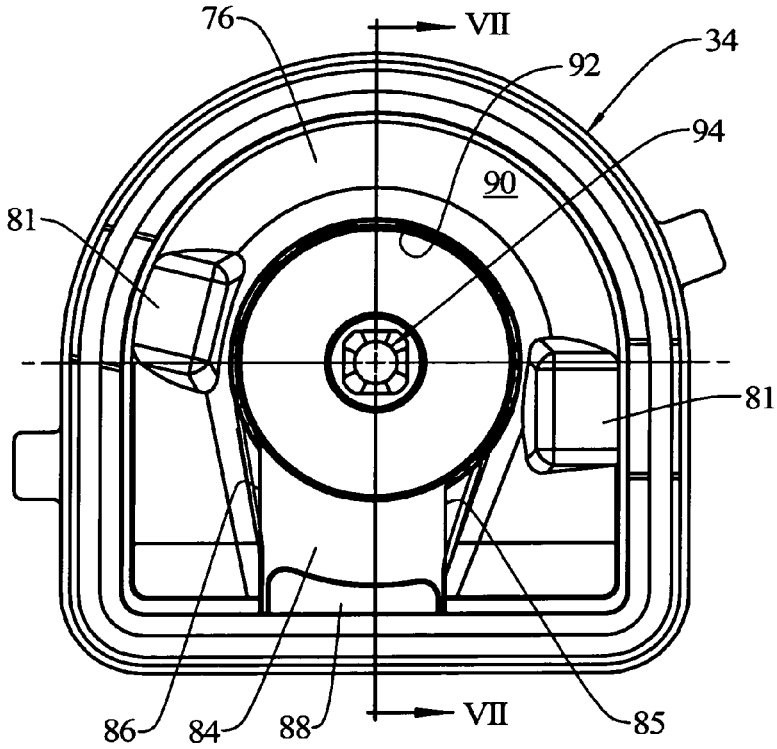
FIG. 6 is an elevational view of an interior side of the housing cover of the impeller pump of FIG. 2.
Figure 7:
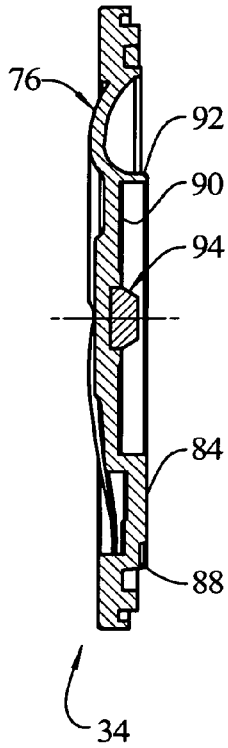
FIG. 7 is a side sectional view of the housing cover taken generally along the line VII-VII of FIG. 6.

To make the enlarged portion, the cover 34 has a wall portion 76 that is configured to enlarge the annular space 74 by extending away from the paddles 56. In an embodiment, the wall portion 76 may have a curved shape in a radial cross section of the housing 30 as shown in FIG. 2. The housing 30 has a bottom wall 78 and an adjoining circumferential wall 80, both of which are spaced away from the paddles 56, at least throughout a portion of the circumference of the annular space 74, as shown at the top portion of FIG. 2, enlarging the annular space in the housing through that portion of the circumference of the annular space, and both of which are positioned relatively close to the paddles, at least throughout a second portion of the circumference of the annular space, as shown at the bottom portion of FIG. 2, diminishing the annular space in the housing through that second portion of the circumference of the annular space. As shown in FIG. 6, the wall portion 76, in its enlarged configuration, extends through an arcuate portion of the circumference of the annular space, at least between the two clip detents 81 formed in the cover 34.

The diminished size of the annular space 74 in a portion of the circumference of the annular space is provided by a cutwater 82 formed in the housing 32 and a cutwater 84 formed in the cover 34. The housing cutwater 82 and the cover cutwater 84 overlie one another and are positioned between the inlet 70 and outlet 72 of the housing 30. The cutwaters 82, 84 direct the liquid being pushed by the paddles 56 to the outlet 72, rather than being recirculated within the pump housing 30. In order to reduce the snagging of lint and similar types of debris in the liquid being pumped, leading 84 and trailing 86 edges of the cutwaters are gently rounded, rather than having sharp corners as in presently available impeller pumps. Also the height of the housing cutwater 82, which is formed along the circumferential wall 80, is increased to extend into the area of the cover 34, and the corresponding area in the cover is recessed as at 88, to receive the housing cutwater. In this way, the gap that presently exists in available impeller pumps, between the housing cutwater and the cover cutwater, will be moved out of the region exposed to the flow of liquid in the pump housing, decreasing the likelihood that lint will collect in this gap.

The cover cutwater 84 extends along an inside surface 90 of the cover 34 to merge with a circumferential rib 92 which surrounds the support ring 54 as shown in FIG. 2. This merging again reduces and eliminates sharp edges which might otherwise become areas where lint and other debris collects.

The cover includes a bearing 94 which may be molded into place, or press fit into place. The cover bearing 94 is engaged by the impeller bearing plate 60, as shown in FIG. 2. In the presently available construction, the cover bearing 94 is a ceramic material, as is the impeller bearing plate 60. In the present invention, the impeller bearing plate 60 is preferably made of stainless steel in order to reduce the heat generated between the impeller bearing plate and the cover bearing 94.

In an embodiment, as shown in FIG. 2, the housing 30 includes the seal assembly 48 between the body 32 and the impeller 36 with a circumferential rib 96 formed in the housing surrounding the seal assembly. The circumferential rib 96, in conjunction with a downward extension 98 of the support ring 54, presents a sinuous path from the area occupied by the paddles 56 and the seal 48, which helps to prevent debris from entering the area of the seal. While the circumferential rib 96 helps prevent the movement of debris into this area, it does not eliminate the entry of such debris. One particular type of debris that might enter this area and cause sever damage to the seal 48, and in particular to a rubber boot portion of the seal, are thin metal chains which become wrapped around the seal, and continue to rotate against the stationary seal as the impeller 36 rotates. To reduce or eliminate damage from this type of debris, the circumferential rib 96 may have a window 100 formed therein along a portion of its circumference, and a top surface 102 of the rib may be broken by the window. Long chains will catch on the edge of the window 100, and will be prevented from continuing to rotate, thereby reducing the rubbing of the chain against the seal 48. The window 100 is preferably formed in the rib 96 on an outlet side of the body 32 (as shown in FIG. 8) to minimize the amount of debris that will flow in through this window and to allow debris that has navigated a path over the rib into the seal area to leave this area, into the outlet stream.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A pump impeller comprising:

a sleeve with a central pocket formed therein for receiving a drive shaft, a support ring surrounding the sleeve, a plurality of paddles attached to the support ring at radially inward ends thereof and extending radially outwardly, without further attachment to other portions of the impeller, a hub surrounding the sleeve;

a top face wall lying substantially perpendicular to an axis of rotation of the impeller, and a plurality of curved impeller blades extending from a bottom side of the top face wall and between the hub and the support ring.

2. A pump impeller according to claim 1, further including a face seal carried in the hub.

3. A pump impeller according to claim 1, wherein the hub comprises a cylindrical hub wall spaced outwardly of the sleeve by a plurality of radial walls.

4. A pump impeller according to claim 1, including a plurality of openings through the top face wall.

5. A pump impeller according to claim 1, including a top face wall lying substantially perpendicular to an axis of rotation of the impeller and wherein the top face wall terminates radially at the support ring.

6. A pump impeller according to claim 1, including a thrust bearing carried at a closed end of the sleeve.

7. An impeller pump comprising:

a housing formed of a body and a cover assembled onto the body, the body having a fluid inlet and a fluid outlet and an opening for receiving a rotating drive shaft, an impeller rotatably positioned in the housing with water moving blades at a periphery thereof, a seal assembly extending between the body and the impeller, the body and cover defining an annular space circumferentially extending around an interior of the housing for receiving the water moving blades of the impeller, the cover having a wall portion configured to enlarge the annular space in the housing through a portion of the circumference of the annular space, a circumferential rib formed in the housing surrounding the seal assembly, and a window formed in the rib along a portion of its circumference.

8. An impeller pump according to claim 7, wherein a top surface of the rib is broken by the window.

9. An impeller pump according to claim 7, wherein the window is positioned on a fluid outlet side of the body.

10. An impeller pump according to claim 7, wherein a cutwater is formed in the annular space within the housing between the inlet and the outlet, and a leading and a trailing edge of the cutwater are rounded.

11. An impeller pump according to claim 7, wherein the cutwater is formed in both the body and the cover.

12. An impeller pump according to claim 11, wherein a portion of the cutwater formed in the body extends into a recess formed in the cover.

13. An impeller pump according to claim 11, wherein the cutwater formed in the cover is connected to a rib surrounding the support ring of the impeller.

14. An impeller pump comprising:

a body and a cover assembled onto the body to form a housing, the body having a fluid inlet and a fluid outlet and an opening for receiving a rotating drive shaft, an impeller rotatably positioned in the housing with paddles at a periphery thereof, the impeller comprising:

a sleeve with a central pocket formed therein for receiving a drive shaft, a hub surrounding the sleeve, a face seal carried in the hub, a circumferential support ring surrounding the hub, a plurality of radially extending paddles extending from the circumferential support ring, a top face wall lying substantially perpendicular to an axis of rotation of the impeller, and a plurality of curved impeller blades extending from a bottom side of the top face wall and between the hub and the circumferential support ring, the body and cover defining an annular space circumferentially extending around an interior of the housing for receiving the paddles of the impeller, the cover having a wall portion configured to enlarge the annular space in the housing through a portion of the circumference of the annular space.

15. A pump impeller according to claim 14, including a top face wall lying substantially perpendicular to an axis of rotation of the impeller terminating radially at the circumferential support ring.

* * * * *

UNITED STATES PATENT AND TRADEMARK OFFICE

CERTIFICATE OF CORRECTION

PATENT NO. : 7,572,097 B2
APPLICATION NO. : 11/431386
DATED : August 11, 2009
INVENTOR(S) : Laurel B. Jaeger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 440 days.

Signed and Sealed this

Seventh Day of September, 2010

David J. Kappos

David J. Kappos
*Director of the United States Patent and Trademark Office*